US012048983B2

(12) United States Patent
Hykes

(10) Patent No.: US 12,048,983 B2
(45) Date of Patent: Jul. 30, 2024

(54) GRINDING MACHINE CENTERING GAUGE

(71) Applicant: Fives Landis Corp., Hagerstown, MD (US)

(72) Inventor: Timothy W. Hykes, Greencastle, PA (US)

(73) Assignee: Fives Landis Corp., Hagerstown, MD (US)

( * ) Notice: Subject to any disclaimer, the term of this patent is extended or adjusted under 35 U.S.C. 154(b) by 388 days.

(21) Appl. No.: 17/511,932

(22) Filed: Oct. 27, 2021

(65) Prior Publication Data

US 2023/0128675 A1 Apr. 27, 2023

(51) Int. Cl.
*B24B 41/06* (2012.01)
*B24B 49/02* (2006.01)

(52) U.S. Cl.
CPC ..... *B24B 41/061* (2013.01); *B24B 49/02* (2013.01)

(58) Field of Classification Search
CPC ..... B24B 41/061
USPC ..... 33/644
See application file for complete search history.

(56) References Cited

U.S. PATENT DOCUMENTS 4,706,004 A 11/1987 Komatsu et al.
4,790,545 A * 12/1988 Dzewaltowski ... B23Q 17/2291 33/645
5,452,521 A * 9/1995 Niewmierzycki ... G01B 11/272 414/936
5,561,242 A * 10/1996 Naumann ..... B23B 5/28 73/66
5,839,943 A * 11/1998 Stadtfeld ..... B24B 3/06 73/104
6,067,721 A 5/2000 Dall'Aglio et al.
6,298,571 B1 10/2001 Dall'Aglio et al.
6,430,832 B1 8/2002 Dall'Aglio et al.
(Continued)

FOREIGN PATENT DOCUMENTS

JP H0957590 A 3/1997
JP 2003251558 A 9/2003
(Continued)

OTHER PUBLICATIONS

International Search Report for International Application No. PCT/US2021/056783 dated Jul. 19, 2022 (3 pages).
(Continued)

*Primary Examiner* — George B Bennett
(74) *Attorney, Agent, or Firm* — REISING ETHINGTON P.C.

(57) ABSTRACT

A workpiece centering gauge for a grinding machine includes a link having a first pivot configured to couple with the grinding machine; a first encoder that measures an angle of the link at the first pivot; a second pivot included with the link; a measuring fork configured to releasably contact an outer surface of an elongated workpiece; a surface feeler, having a transducer, included with the measuring fork that measures a workpiece diameter a second encoder that measures an angular position of the link relative to the measuring fork; the angular position measured by the first encoder, the angular position measured by the second encoder, and a measured workpiece diameter are used to determine a deviation of the elongated workpiece from a centerline.

13 Claims, 9 Drawing Sheets

(56) References Cited

U.S. PATENT DOCUMENTS

| | | | | |
|---|---|---|---|---|
| 6,568,096 | B1 * | 5/2003 | Svitkin | B23Q 17/20 82/162 |
| 6,643,943 | B2 | 11/2003 | Dall'Aglio et al. | |
| 6,848,190 | B2 | 2/2005 | Dall'Aglio et al. | |
| 6,931,749 | B2 | 8/2005 | Dall'Aglio | |
| 7,020,974 | B2 | 4/2006 | Danielli et al. | |
| 7,024,785 | B2 | 4/2006 | Dall'Aglio et al. | |
| 7,047,658 | B2 | 5/2006 | Danielli et al. | |
| 7,325,324 | B2 | 2/2008 | Dall'Aglio et al. | |
| 7,464,482 | B2 | 12/2008 | Dall'Aglio et al. | |
| 7,607,239 | B2 | 10/2009 | Dall'Aglio et al. | |
| 7,690,127 | B2 | 4/2010 | Dall'Aglio et al. | |
| 7,712,228 | B2 * | 5/2010 | Calas | B23Q 3/152 414/781 |
| 7,954,253 | B2 | 6/2011 | Dall'Aglio et al. | |
| 8,231,428 | B2 * | 7/2012 | Poling, Sr. | B24B 41/002 451/920 |
| 8,286,361 | B2 | 10/2012 | Dall'Aglio et al. | |
| 8,336,224 | B2 * | 12/2012 | Arnold | B24B 5/04 33/555.1 |
| 8,429,829 | B2 * | 4/2013 | Arnold | B24B 49/045 33/555.1 |
| 8,667,700 | B2 | 3/2014 | Dall'Aglio et al. | |
| 8,678,879 | B2 * | 3/2014 | Araki | B24B 5/42 451/49 |
| 9,393,663 | B2 * | 7/2016 | Volk | B24B 49/045 |
| 11,268,799 | B2 * | 3/2022 | Dall'Aglio | B24B 49/183 |
| 11,279,027 | B2 * | 3/2022 | Clever | B25J 9/1653 |
| 2003/0009895 | A1 * | 1/2003 | Dall'Aglio | B24B 5/42 33/555.3 |
| 2017/0014971 | A1 | 1/2017 | Junker | |

FOREIGN PATENT DOCUMENTS

| | | | |
|---|---|---|---|
| JP | 2007206086 | A | 8/2007 |
| KR | 20110036794 | A | 4/2011 |

OTHER PUBLICATIONS

Written Opinion for International Application No. PCT/US2021/056783 dated Jul. 19, 2022 (4 pages).

* cited by examiner

GRINDING MACHINE CENTERING GAUGE

The present application relates to workpiece grinding and, more particularly, to measuring workpiece location with a grinding machine.

BACKGROUND

Grinding machines can be used to shape the outer surface of elongated workpieces. For example, an elongated workpiece, such as a crankshaft can be held with a headstock and a footstock. The elongated workpiece can be firmly held and rotated as one or more grinding wheels engage an outer surface of the workpiece to remove a defined amount of material and create a precisely shaped surface. The grinding process carried out by the machines involves precisely locating both the elongated workpiece and the grinding wheel(s) and controlling the position of the grinding wheels relative to the surface of the workpiece to very accurately remove material and create a surface. However, even with the precise knowledge of the grinding wheel(s) and the spatial position of the headstock and footstock, some error can exist. It would be helpful to implement a system that reduced this error.

SUMMARY

In one implementation, a workpiece centering gauge for a grinding machine includes a link having a first pivot configured to couple with the grinding machine; a first encoder that measures an angle of the link at the first pivot; a second pivot included with the link; a measuring fork configured to releasably contact an outer surface of an elongated workpiece; a surface feeler, having a transducer, included with the measuring fork that measures a workpiece diameter a second encoder that measures an angular position of the link relative to the measuring fork; the angular position measured by the first encoder, the angular position measured by the second encoder, and a measured workpiece diameter are used to determine a deviation of the elongated workpiece from a centerline.

In another implementation, a grinding machine with one or more grinding wheels includes a workpiece holder that releasably holds an elongated workpiece and is configured to rotate the elongated workpiece about a longitudinal axis; and a workpiece centering gauge includes: a link having a first pivot configured to couple with the grinding machine; a first encoder that measures an angle of the link at the first pivot; a second pivot included with the link; a measuring fork configured to releasably contact an outer surface of a workpiece; a transducer included with the measuring fork that measures a workpiece diameter; and a second encoder that measures an angular position of the link relative to the measuring fork; the angular position measured by the first encoder, the angular position measured by the second encoder, and workpiece diameter size are used to determine the deviation of the elongated workpiece from a center.

DETAILED DESCRIPTION

Figure 1:
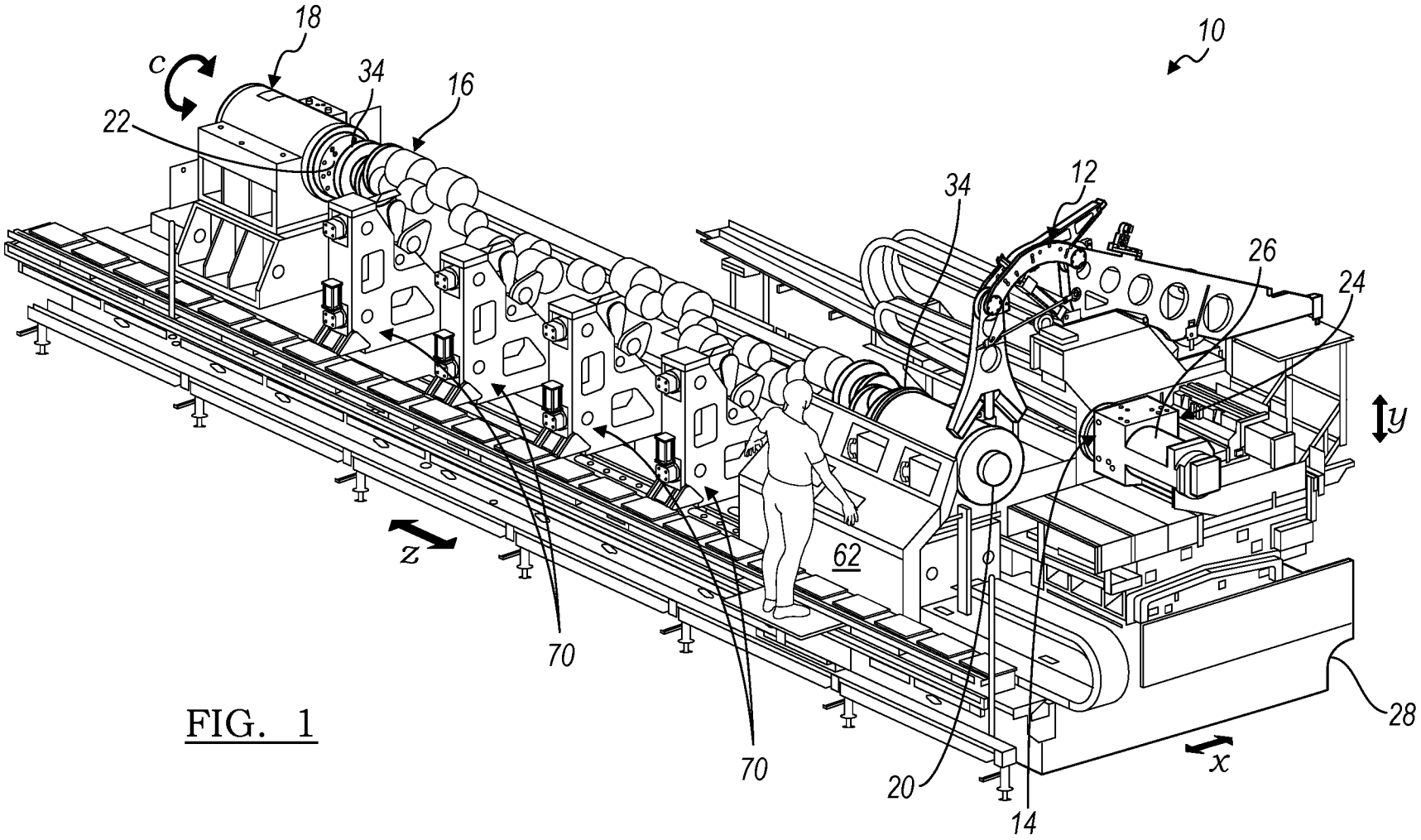
FIG. 1 is a perspective view depicting an implementation of a grinding machine having a workpiece centering gauge.
Figure 2:
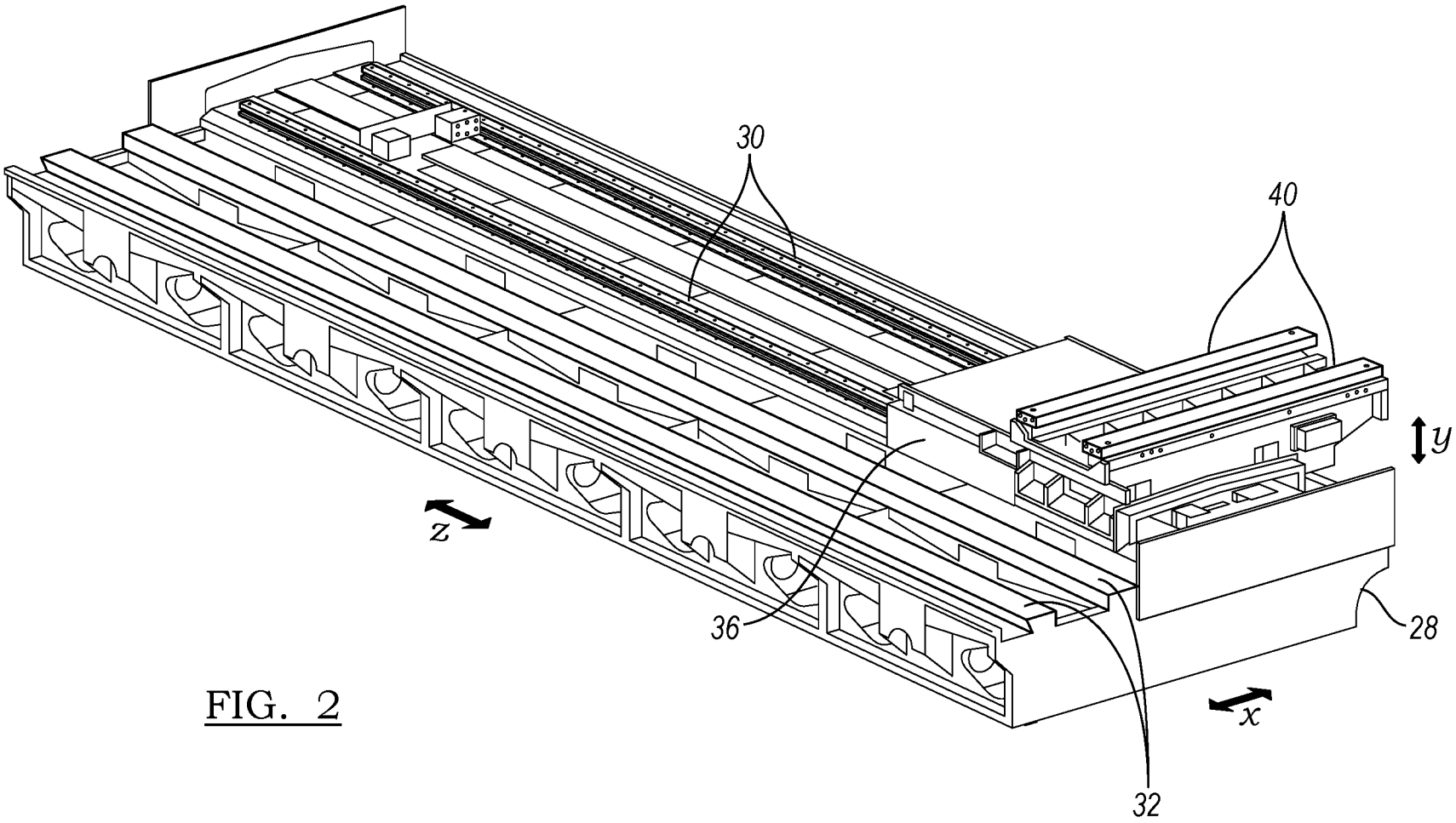
FIG. 2 is a perspective view depicting a portion of an implementation of a grinding machine having a workpiece centering gauge.
Figure 3:
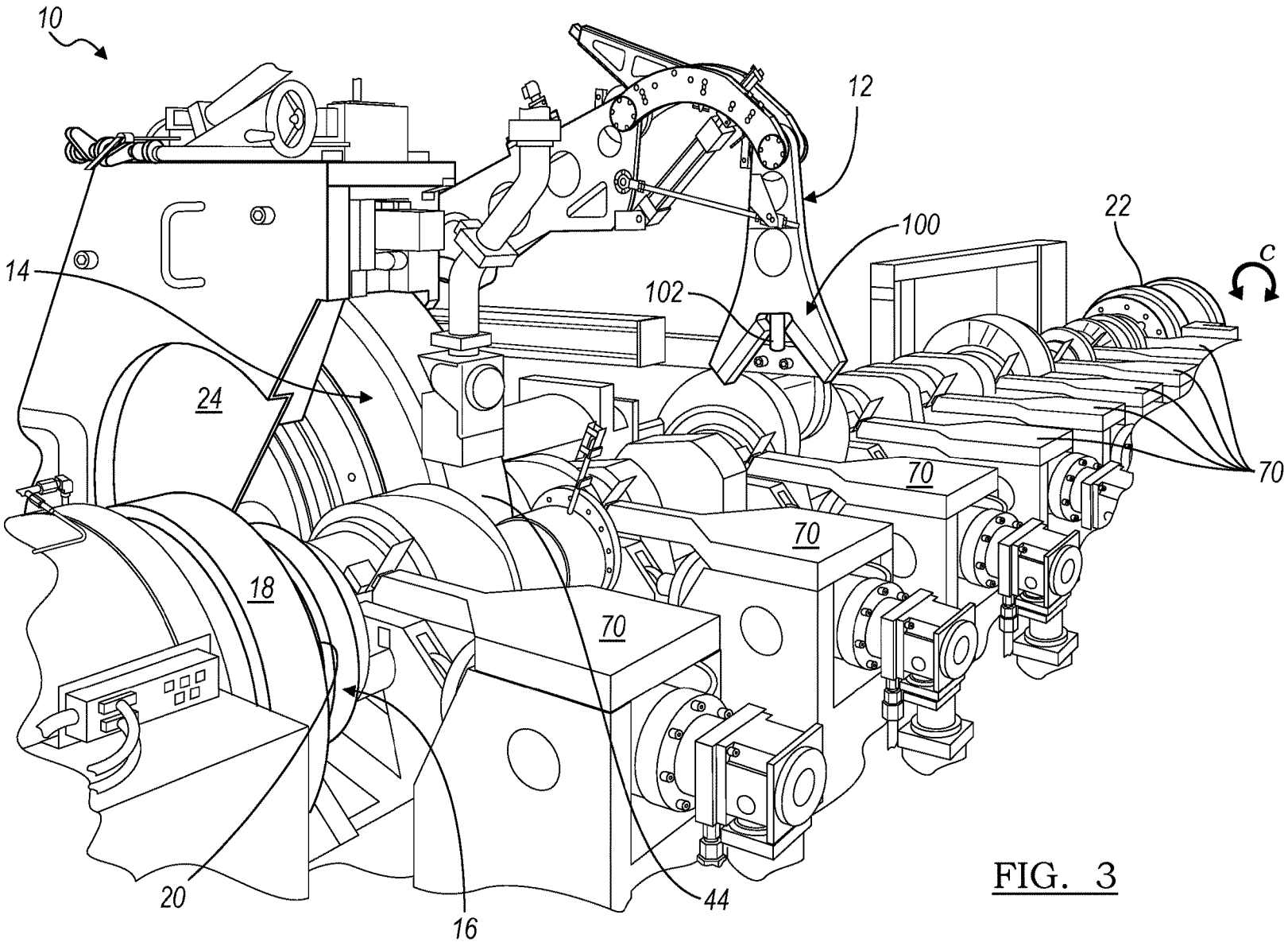
FIG. 3 is another perspective view depicting an implementation of a grinding machine having a workpiece centering gauge.
Figure 4:
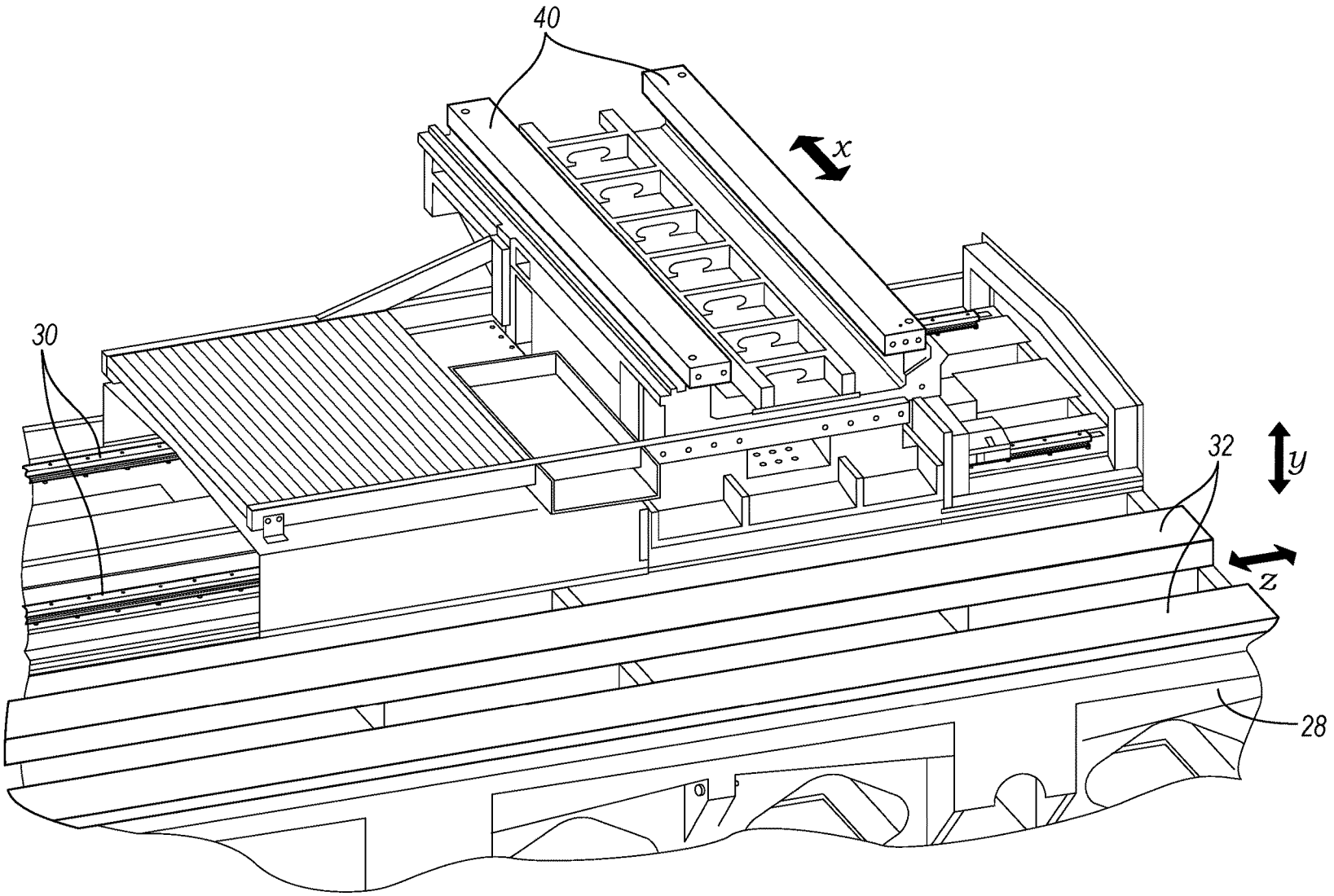
FIG. 4 is another perspective view depicting a portion of an implementation of a grinding machine having a workpiece centering gauge.
Figure 5:
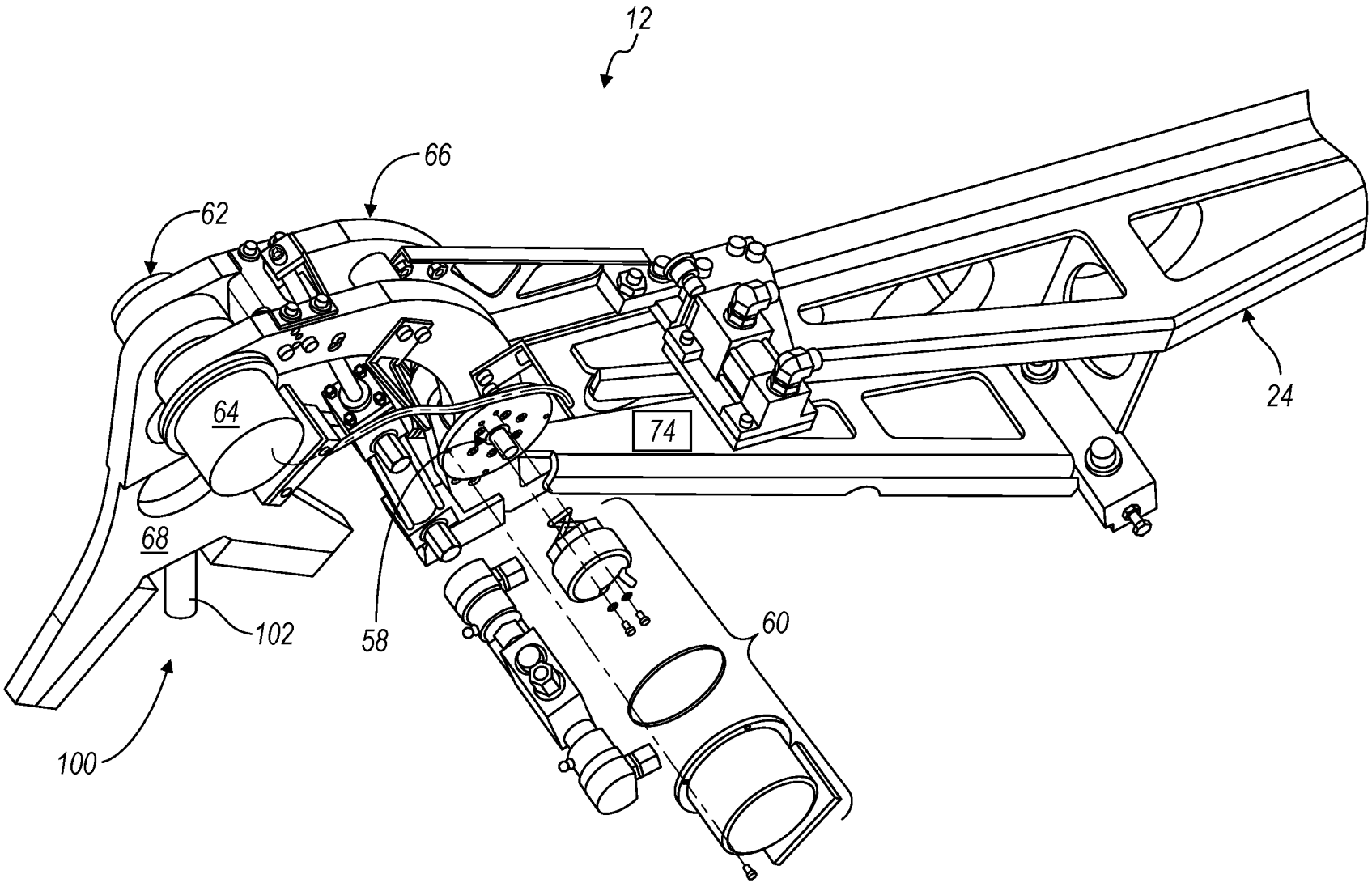
FIG. 5 is a partially exploded view depicting an implementation of a workpiece centering gauge.
Figure 6:
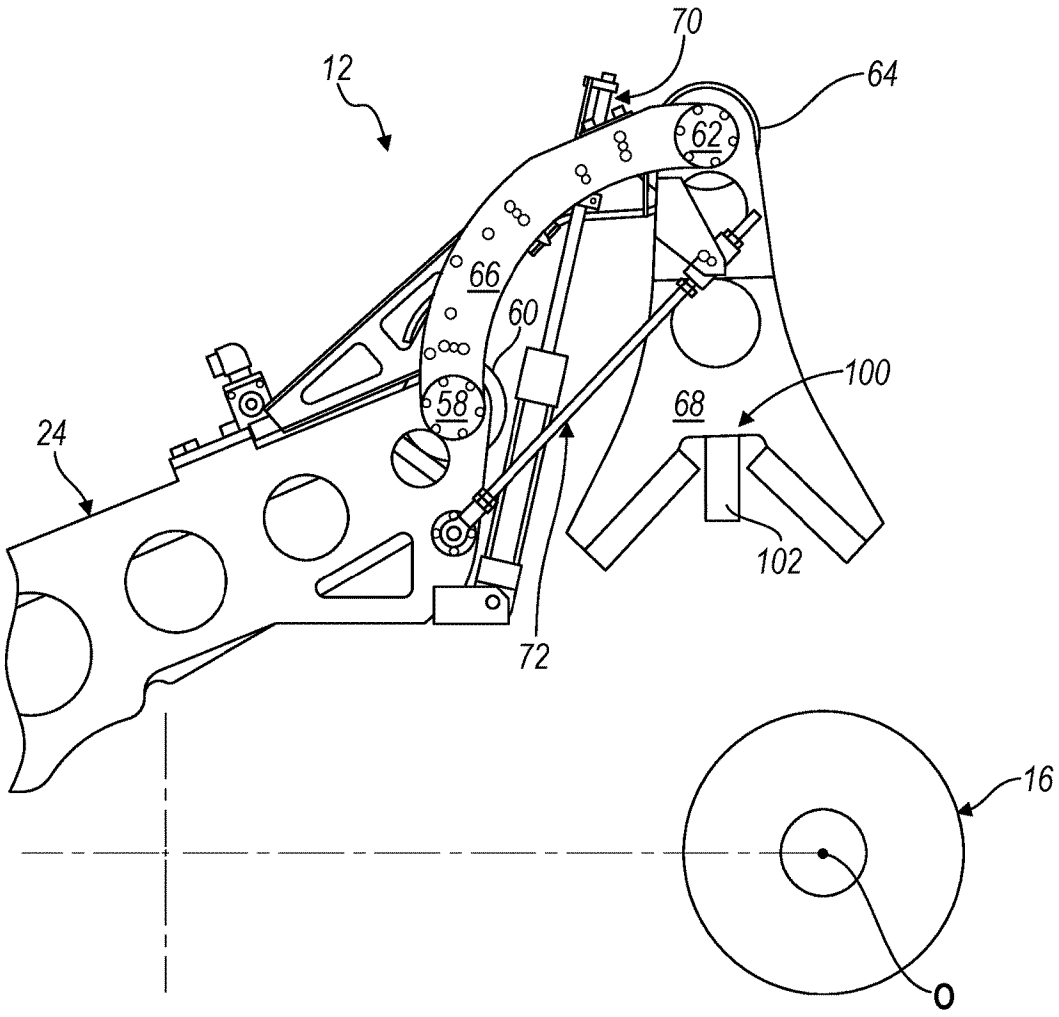
FIG. 6 is a profile view depicting an implementation of a workpiece centering gauge.
Figure 7:
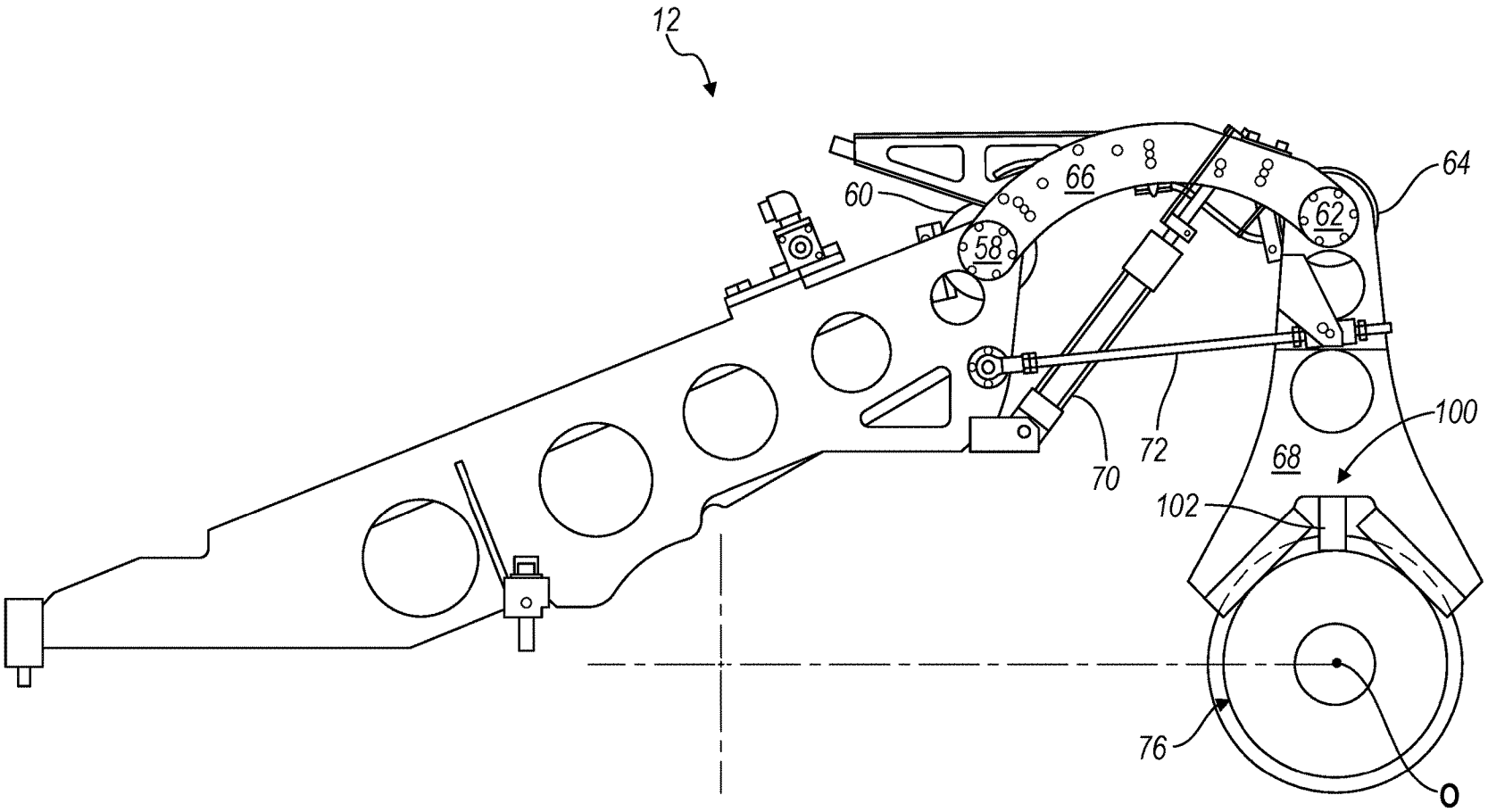
FIG. 7 is another profile view depicting an implementation of a workpiece centering gauge.

Grinding machines can include a workpiece centering gauge comprising a linkage mounted at a fixed location with a measuring fork attached to a distal end. The measuring fork includes a surface feeler having a transducer for determining workpiece size. The workpiece centering gauge includes at least a link, a measuring fork, the surface feeler, and at least two pivotable joints with an encoder integrated at each joint. For example, the workpiece centering gauge can include a first pivot fixedly attached to the grinding machine at one end of the link. A second pivot located at a distal end of the link can pivotably attach to the measuring fork, which touches a surface of the workpiece to determine the actual location of the workpiece centerline. The workpiece centering gauge, using its plurality of encoders and the surface feeler, can very accurately determine the actual size of the workpiece at an axial location and the actual centerline of the workpiece. The workpiece centering gauge can measure the size of the workpiece at an axial location with the surface feeler and, using the actually-measured size, can determine relative angles at each encoder to calculate the polar coordinates of the workpiece centerline given the determined angles, measured workpiece size, and the known length of the links. After measuring the workpiece size, the workpiece centering gauge can determine the position off the workpiece centerline. Also, the links can be configured to move about the pivots within a single plane of motion.

Determining the actual location of the workpiece centerline using the measured workpiece surface can be particularly helpful when grinding larger elongated workpieces that may have a tendency to slightly sag or change shape while engaged by a headstock and a footstock of the grinding machine. For example, crankshafts that are 1.5 meters (m) or longer may use work rests to support one or more sections of the crankshaft in between the headstock and the footstock to prevent the crankshaft from sagging or assuming a non-ideal shape. That is, a grinding machine can be programmed with a theoretical location of a workpiece centerline but, especially with respect to larger elongated workpieces, the theoretical location may differ from the actual location of the workpiece centerline by a non-insignificant amount. For example, the theoretical location and the actual location can differ by 2 millimeters (mm) or more. The actual location of the workpiece centerline can be compared to the theoretical or desired location of the workpiece centerline and the work rests can be mechanically adjusted along three axes to support the workpiece in a way that places the workpiece centerline, and thereby the workpiece surface, in the theoretical or desired location thereby compensating for the sag or distortion. While some embodiments here are described with reference to a crankshaft, the disclosure here should also be understood to be applicable to other elongated workpieces as well.

FIGS. 1-4 depict a grinding machine 10 that includes a workpiece centering gauge 12 that measures the spatial location of a workpiece surface. In this embodiment, the grinding machine 10 is an orbital grinding machine designed to grind outer surfaces of crankshaft workpieces. More specifically, the orbital grinding machine can use one or more grinding wheels 14 to create journal surfaces and crankpin surfaces on a crankshaft 16. In this implementation, the orbital grinding machine 10 can accommodate crankshafts small as 1.5 meters (m) and as long as 12 m. Implementations of such a grinding machine 10 includes a Fives Landis LT2HHe or a LT3e orbital crankshaft grinding machine. However, other embodiments using different types of workpieces or grinding machines can use the locating gauge to determine the position of the workpiece surface.

The orbital grinding machine 10 can include a workpiece holder 18 having a headstock 20 and a footstock 22, a grinding wheel assembly 24 including a spindle assembly 26 coupled to the grinding wheel 14, and a machine bed 28. The machine bed 28 can be a relatively planar structure that rests on a floor and supports the elements of the grinding machine 10. For example, the machine bed 28 can support the headstock 20 and footstock 22 on a surface of the machine bed 28 so that the crankshaft 16 is engaged with both the headstock 20 and footstock 22 and raised above the bed 28. The machine bed 28 can be rectangular such that it is longer in length along a Z-axis than it is along a X-axis. One or more grinding wheel rails 30 can extend along the surface of the machine bed 28 along the Z-axis to facilitate movement of the grinding wheel assembly 24 along the Z-axis, such that the grinding wheel assembly 24 slides or rolls along the rails 30 in either direction to position the grinding wheel at a particular axial point along the X-axis. The grinding wheel assembly can be moved over the rails 30 along the Z-axis using a linear servo motor and optical scales can be used to identify the position of the grinding wheel 16 along the X-axis.

One or more workpiece holder rails 32 can be spaced apart from the grinding wheel rails 30, positioned opposite the grinding wheel rails 30 on the machine bed 28, extending along the Z-axis. The headstock 20 and the footstock 22 can slide or roll along the workpiece holder rails 32 to adjust for crankshafts having different axial lengths and engage a head of the crankshaft 16 and a tail of the crankshaft 16, respectively, with a workpiece holder 34, such as a chuck or collet, thereby holding the crankshaft 16 in a particular place. The workpiece holder 34 of the headstock 20 and the workpiece holder 34 of the footstock 22 can each include an electric motor that can, collectively in coordination, rotate the crankshaft 16 about its longitudinal axis (C) in a 360-degree range of motion in either angular direction. Rotary encoders can be used at the headstock 20 and at the footstock 22 to determine the angular position of the crankshaft 16. The headstock 20 and footstock 22 can each be individually moved along the Z-axis using servo motors and a rack drive.

The grinding wheel assembly 24 can include a base 36 that sits on the grinding wheel rails 30. The spindle assembly 26 can be supported by the base 36 so that it is moveable along the z-axis over the grinding wheel rails 30 and includes a grinding wheel 14 coupled to the spindle assembly 26, one or more infeed rails 40 in between the base 36 and the spindle assembly 26, a linear servo motor, an optical scale, and the workpiece centering gauge 12. The spindle assembly 26 can include a spindle drive motor that turns a spindle shaft ultimately rotating the grinding wheel 14 coupled to the spindle shaft. The grinding wheel 14 can have a radial surface 44 that contacts the crankshaft 16 and faces outwardly from an axis of spindle shaft rotation ($\alpha$). The spindle drive motor can be concentric with the spindle shaft, such that a rotor of the spindle drive motor 46 is coupled with the spindle shaft and a stator is concentric with the rotor. A forward bearing and a rearward bearing can be positioned on opposite ends of the spindle shaft providing support during operation. The bearings can be implemented as hydrostatic bearings. A rotary encoder 58 can be attached to a distal end of the spindle shaft 48 for determining the angular position, velocity, or acceleration of the spindle shaft 48 and the grinding wheel 14. The infeed rails 40 can extend along the X-axis and be positioned perpendicularly relative to the grinding wheel rails 30.

The spindle assembly 26 can slide closer to and further away from the crankshaft 16 along the X-axis over the infeed rails 40. The linear motor can move the grinding wheel assembly 24 over the infeed rails 40 along the X-axis using an encoder that identifies the position of the grinding wheel assembly 24 along the X-axis.

One or more workrest assemblies 70 can be placed underneath the crankshaft 16 for support to prevent shape distortion of the crankshaft 16. As discussed above, crankshafts that are longer (e.g., >1.5 m) in length that are held between the headstock 20 and the footstock 22 can change shape or sag due to the effect of gravity, temperature, or other environmental factors. Workrest assemblies 70 can be positioned underneath the crankshaft 16 to prevent sag or shape distortion. The workrest assembly 70 can be positioned in the XZ plane at a desired point under the crankshaft 16, and may be adjustable in height in the XY plane using servomotors controlled based on an actual determination of workpiece centerline to engage the crankshaft 16 and place the crankshaft 16 at a defined height. In that way, the workrest assembly 70 can be adjustable along three axes. The workrest assemblies 70 can include adjustable arms that can be moved closer to or further away from each other so that they engage an outer surface of the crankshaft 16. The arms are adjustable to accommodate different diameter and shapes of crankshafts 16. The workrest assemblies 70 can be positioned to engage the crankpins of the crankshaft 16. For example, the workrest assemblies 70 can slide along rails on the machine bed 28 that extend in the X-direction and the Z-direction. In some implementations, the rails can have an inverted dovetail cross-sectional shape. That is, the machine bed 28 can include elongated mortise slots that receive tenons included on the workrest assemblies 70. The workrest assemblies 70 can slide along the surface of the machine bed 28 within the slots.

Turning to FIGS. 5-9, an implementation of the workpiece centering gauge 12 that can be carried by the grinding machine 10 is shown. In this implementation, the workpiece centering gauge 12 includes a first pivot 58 with a first encoder 60 coaxial to the first pivot 58 and a second pivot 62 with a second encoder 64 coaxial to the second pivot 62. The workpiece centering gauge 12 can be attached to the grinding wheel assembly 24 at the first pivot 58 connected to a link 66. The link 66 can be an elongated member that extends away from the grinding machine 10 and attaches to a measuring fork 68 at a distal end of the link 66 at the second pivot 62. The measuring fork 68 can include a V-shaped end with two opposing planar surfaces that releasably engage an outer surface of the crankshaft 16.

The measuring fork 68 can include a surface feeler 100 that measures a workpiece diameter, and optionally workpiece surface shape. The surface feeler 100 can include a piston 102 that is slidably received by the measuring fork 68. The piston 102 can be biased away from the measuring fork 68 towards the crankshaft 16 by a spring or other biasing member. The piston 102 can be in operational engagement with a transducer that measures linear movement of the piston 102 relative to the measuring fork 68. As the measuring fork 68 is moved to engage a surface of the crankshaft 16, such as a main bearing, the piston 102 engages the workpiece surface and slides linearly relative to the measuring fork 68 overcoming the force of the spring until the planar surfaces contact the crankshaft 16. The transducer can communicate, to a computer processor 74, the amount of linear movement of the piston 102 relative to the measuring fork 68 from the point when the piston 102 contacts the crankshaft 16 until the planar surfaces contact the workpiece surface and the piston 102 stops moving relative to the measuring fork 68. The surface feeler 100 can provide the grinding machine 10 an actual measurement of the diameter of crankshaft 16 at a given point, such as at the main bearing. It is also possible at this point to rotate the crankshaft 16 while the piston 102 and the measuring fork 68 are engaged with the workpiece surface. Movement of the piston 102 relative to the measuring fork 68 can be monitored to determine the surface shape of the crankshaft 16.

Movement of the link 66 and the measuring fork 68 can be effectuated using a variety of mechanisms, such as a linear piston. For example, a link piston 70 can pivotably attach to the grinding wheel assembly 24 and the link 66. As the link piston 70 expands in length, the angular position of the link 66 can change relative to the grinding wheel assembly 24 about the first pivot 58. The first encoder 60 can detect the angular position of the link 66 relative to the first pivot 58. The term "piston" can be broadly interpreted as any linear actuator, such as a ball screw or a hydraulic piston, however other mechanical mechanisms for moving the link 66 and the measuring fork 68 are possible. For example, the first pivot 58 and the second pivot 62 can use stepper motors to move the link 66 and measuring fork 68 relative to the grinding wheel assembly 24. A fork limiting rod 72 can pivotably attach to the grinding wheel assembly 24 and the measuring fork 68. As the measuring fork 68 is moved toward the crankshaft 16, the angular position of the measuring fork 68 relative to the second pivot 62 can be limited. The second encoder 64 can detect the angular position of the measuring fork 68 relative to the second pivot 62.

After the link 66 and measuring fork 68 have been moved about the pivots 58, 62 into engagement with an outer surface 76 of the crankshaft 16 and the diameter of the crankshaft 16 has been measured, the workpiece centering gauge 12 can measure relative angles at and between the pivots 58, 62 using the first encoder 60 and the second encoder 64. A number of different types of encoders could be used to implement the first encoder 60 or the second encoder 64. The workpiece centering gauge 12 can be calibrated by mounting a master diameter on the workpiece holder 18 at a workpiece centerline. The measuring fork 68 can engage an outer surface of the master diameter to provide a known data point while the first encoder 60 measures an angle and the second encoder 64 measures an angle. Data from the surface feeler 100 as it contacts the master diameter can be combined with the measured angles by the gauge 12 to determine the diameter of the master diameter. The angles determined by the first encoder 60 and the second encoder 64 while the measuring fork 68 is engaged with the master diameter can calibrate the gauge 12 relative to the work centerline. If the calculated diameter or centerline of the master diameter does not match the known diameter or centerline, the gauge 12 can be adjusted so that future measurements are accurate. In one implementation, a Heidenhain type ECN413 encoder can be used. The measured angles can be used along with known length of the link 66 and the measuring fork 68 as well as the dimensions of the measuring fork 68 to determine the actual center of the crankshaft 16. In other implementations, it is possible to use more than two pivots and more than two encoders.

Figure 8:
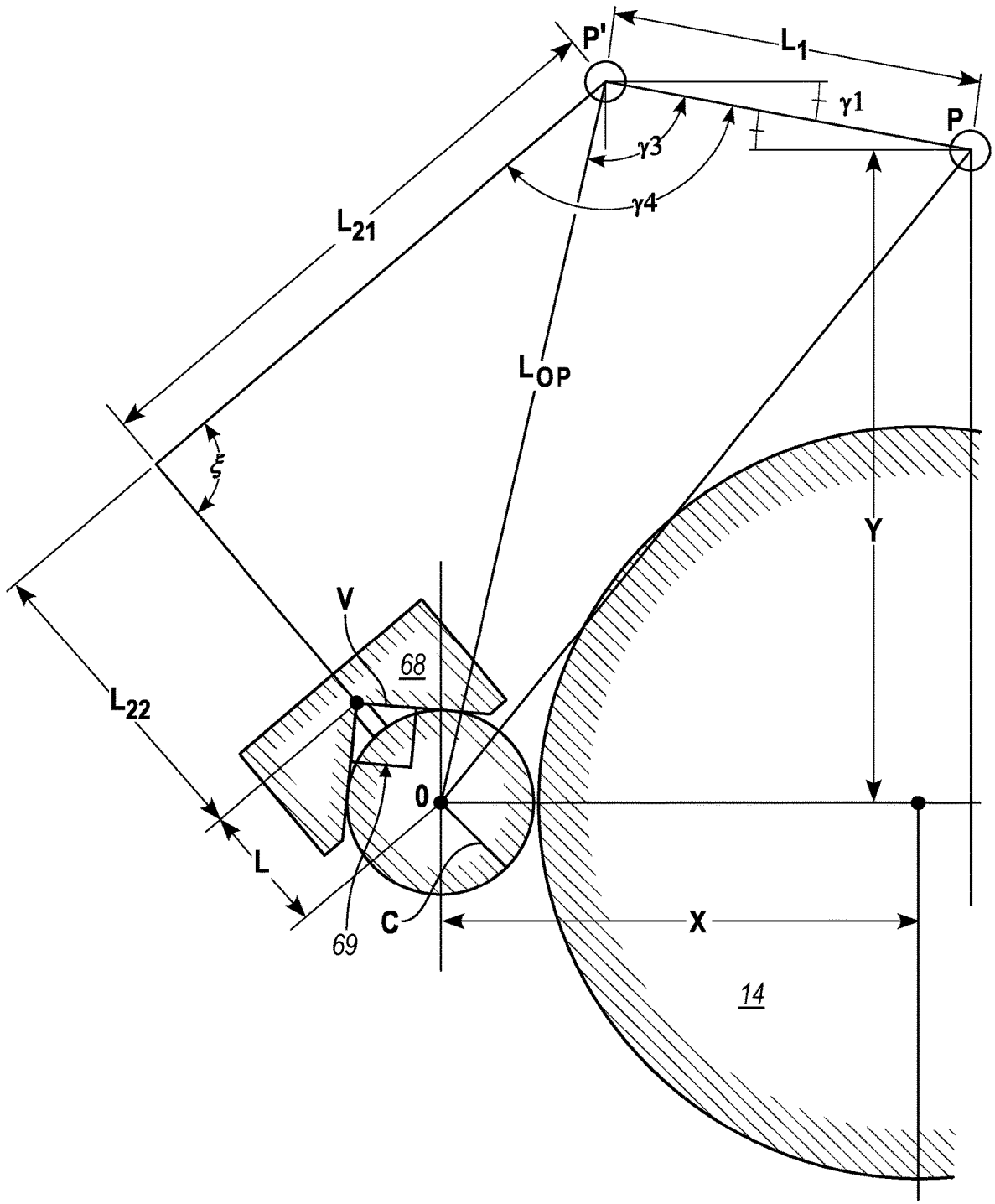
FIG. 8 is a mathematical diagram depicting measurements determined by an implementation of a workpiece centering gauge.
Figure 9:
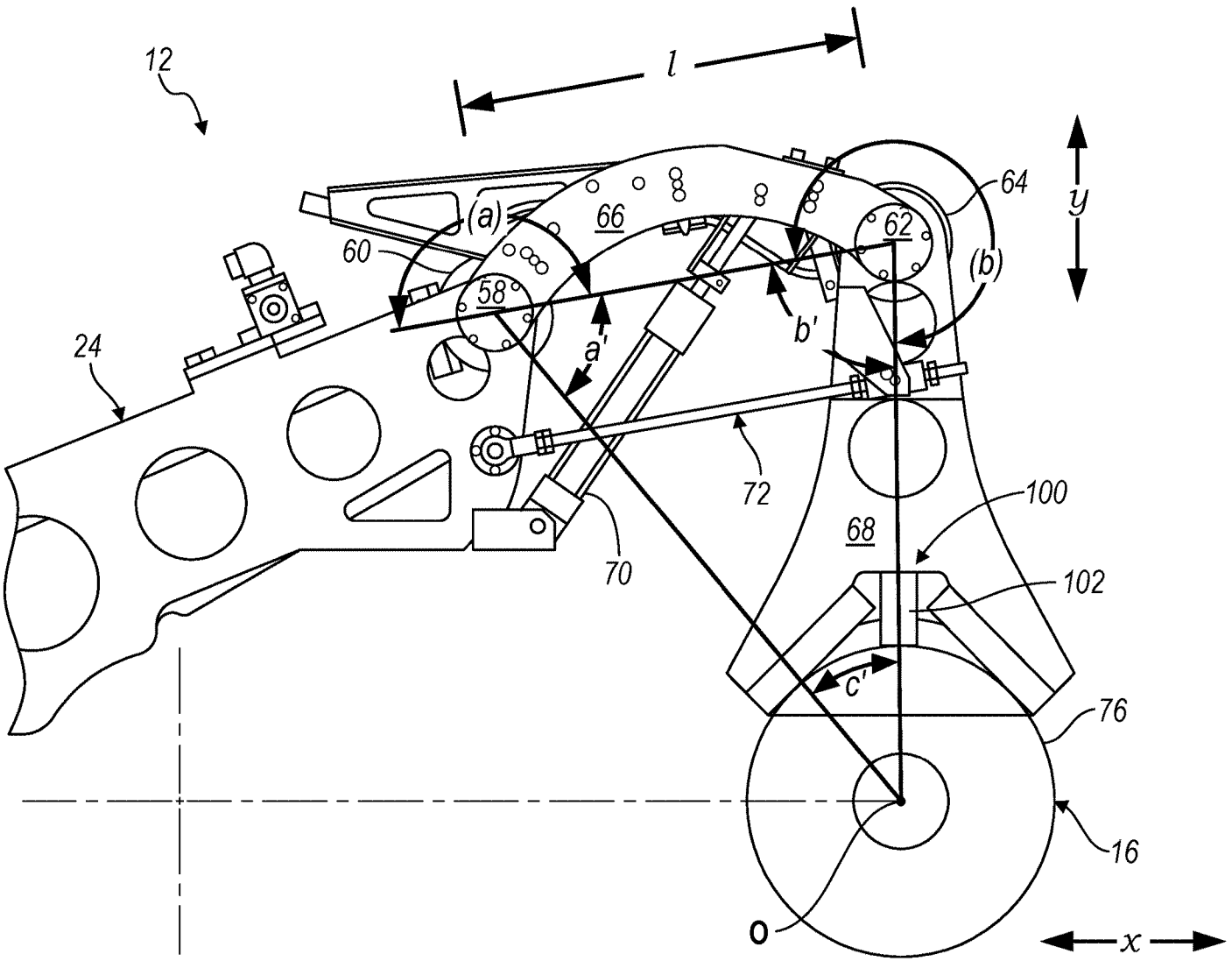
FIG. 9 is another profile view depicting an implementation of a workpiece centering gauge.

The actual center of the crankshaft 16 can be calculated using the following variables, shown in FIG. 8, and formulas detailed below.

Constants for these calculations are:

P (X,Y)—First pivot point with X axis in measuring position;

$L_1$—Length of a link from P to P';

$L_{21}$—Length of a virtual upper sub arm;

$L_{22}$—Length of a virtual second sub arm from $L_{21}$ to gauge vee intersection;

V—Included vee angle of the measuring fork;

XI (ξ)—Angle between $L_{21}$ and $L_{22}$, chosen to be 90 degrees;

Even though the surface feeler may not be located in the center of the measuring fork 68, these calculations are based on the fact that the center of workpieces having various diameters travel in a line defined by the center of the vee.

Variables provided by the two encoders and surface feeler are:

Gamma1 (γ1)—Angle from X axis (horizontal) to the first arm;

Gamma4 (γ4)—Angle from the first arm to $L_{21}$;

C·Work radius;

L—dimension from work center to gauge vee intersection;

$L_{OP}$—Distance from P' to work center O;

Gamma3 (γ3)—Included angle between first arm and hypotenuse from P' to work center. ($L_{OP}$)

A center of a workpiece, such as the crankshaft 16, can be derived as a series of three polar-to-rectangular coordinate conversions:

L=C/Sin(V/2);

$L_{OP}$=SQRT ($L_{21}$^2+($L_{22}$+L)^2 );

γ3=γ4—Atan($L_{22}$+L)/$L_{21}$));

P=X1, Y1

P'=X1·$L_1$*Cos(γ1), Y1+$L_1$*Sin(γ1) defined as X2, Y2

O=X2+$L_{OP}$*Cos(−γ1−γ3), Y2·Sin Cos(−γ1−γ3)

An example follows of how the first pivot 58, the first encoder 60, the second pivot 62, and the second encoder 64, a known length (1) of the link 66, known dimensions of the measuring fork 68, and a measured diameter of the crankshaft 16 can be used to determine a deviation of the crankshaft centerline (O). The crankshaft 16 can extend along the Z-axis and the center (O) of the crankshaft 16 can be given a theoretical location of (0, 0), which indicates that the center is not offset from the Z-axis in either the X- or Y axes. Given this theoretical location of the centerline of the crankshaft 16, the workpiece centering gauge 12 can be moved to contact a location along the outer surface 74 of the crankshaft 12. The link piston 70 and the fork limiting rod 72 can lower the link 66 and the measuring fork 68 so that the fork 68 contacts the outer surface of the crankshaft 16. In one example, several theoretical calculations can be determined. For example, a distance between the first pivot 58 and the second pivot 62 can be 350 mm and a theoretical distance between the second pivot 62 and the theoretical center (O) of the crankshaft 16 can be 291.9634 mm. The diameter of the crankshaft 16 at the location where the measuring fork 68 contacts the crankshaft surface may have been specified to be 181.275 mm. The angle (a) at the first pivot 58 using the first encoder 60 can be 180 degrees and the theoretical angle (b) of the second pivot 62 at the second encoder 64 can be 270 degrees (as measured on a coordinate plane). A theoretical distance from a point of contact of the measuring fork 68 to the second pivot 62 can be 206.4493 mm.

Given the values above, a distance from the centerline (O) of the crankshaft 16 to the first pivot 58 can be determined. In this example, it can be 555.4516566 mm. A triangular relationship can exist between the first pivot 58, the second pivot 62, and the centerline of the crankshaft 16. The angle (a') of the triangle at the first pivot 58 can be calculated as 49.62084375 degrees and the angle (b') of the triangle at the second pivot 62 can be calculated as 90.98928877 degrees. An angle (c') at the centerline of the crankshaft 16 relative to the first pivot 58 and the second pivot 62 can be calculated as 39.38986749 degrees.

The theoretical values can be used as a calibration standard and compared with values that are derived from actual angular measurements measured with the first encoder 60, the second encoder 64, and the surface feeler 100 given the known dimensions of the link 66 and the measuring fork 68. In this example, the first encoder 60 may measure an angle (a) of 179.9869221 degrees and the second encoder 64 can measure angle (b) as 270.98928877 degrees. These angles are different than the theoretical angles of 180 and 270 degrees. Using the angles recorded by the first encoder 60 and the second encoder 64, deviations in the location of the center (c) of the crankshaft 16 can be calculated as 0.0033 mm in the vertical (Y) direction and −0.0039 mm in the horizontal (X) direction. This is one example of how these calculations can be carried out but other ways are possible.

The computer processor 74 can provide input to and receive feedback from a number of components identified above. For example, the servo motors that control the movement of the machine bed 28 along the grinding wheel rails 30, the movement of the grinding wheel assembly 24 along the infeed rails 40, the operation of the spindle shaft 48, and/or the electric motors of the headstock 20 and the footstock 22, as well as the first encoder 60, and second encoder 64 can all receive an input signal from the computer processor 74, such as a commanded motor speed and direction, and also provide an output signal to the computer processor 74, such as actual angular position, angular shaft speed, and/or angular direction. The workpiece centering gauge 12 can provide output to the computer processor 74 in the form of a signal indicating position at the first encoder 60 or the second encoder 64. The computer processor 74 can be any type of device capable of processing electronic instructions including microprocessors, microcontrollers, host processors, controllers, and application specific integrated circuits (ASICs). It can be a dedicated processor used only to carry out the described methods or can be shared with other functionality carried out by the grinding machine 10. The computer processor 74 executes various types of digitally-stored instructions, such as software or firmware programs stored in computer-readable memory. However, it should be appreciated that other implementations are possible in which at least some of these elements could be implemented together on a printed circuit board.

It is to be understood that the foregoing is a description of one or more embodiments of the invention. The invention is not limited to the particular embodiment(s) disclosed herein, but rather is defined solely by the claims below. Furthermore, the statements contained in the foregoing description relate to particular embodiments and are not to be construed as limitations on the scope of the invention or on the definition of terms used in the claims, except where a term or phrase is expressly defined above. Various other embodiments and various changes and modifications to the disclosed embodiment(s) will become apparent to those skilled in the art. All such other embodiments, changes, and modifications are intended to come within the scope of the appended claims.

As used in this specification and claims, the terms "e.g.," "for example," "for instance," "such as," and "like," and the verbs "comprising," "having," "including," and their other verb forms, when used in conjunction with a listing of one or more components or other items, are each to be construed as open-ended, meaning that the listing is not to be considered as excluding other, additional components or items. Other terms are to be construed using their broadest reasonable meaning unless they are used in a context that requires a different interpretation.

What is claimed is:

1. A workpiece centering gauge for a grinding machine, comprising:

a link having a first pivot configured to couple with the grinding machine;

a first encoder that measures an angle of the link at the first pivot;

a second pivot included with the link;

a measuring fork configured to releasably contact an outer surface of an elongated workpiece;

a surface feeler, having a transducer, included with the measuring fork that measures a workpiece diameter; and a second encoder that measures an angular position of the link relative to the measuring fork, wherein the angular position measured by the first encoder, the angular position measured by the second encoder, and a measured workpiece diameter are used to determine a deviation of the elongated workpiece from a centerline.

2. The workpiece centering gauge recited in claim 1, further comprising a link piston coupled to the grinding machine at one end and the link at another end for moving the link relative to the grinding machine.

3. The workpiece centering gauge recited in claim 1, further comprising a fork limiting rod coupled to the link at one end and the measuring fork at another end for limiting angular movement of the measuring fork.

4. The workpiece centering gauge recited in claim 1, wherein polar coordinates are calculated and then converted to cartesian coordinates.

5. The workpiece centering gauge recited in claim 1, wherein the elongated workpiece is a crankshaft.

6. The workpiece centering gauge recited in claim 1, wherein a master diameter is mounted in the machine, the measuring fork engages an outer surface of the master diameter, an angle is measured at the first encoder, and an angle is measured at the second encoder.

7. The workpiece centering gauge recited in claim 1, wherein the elongated workpiece is 1.5 meters (m) or greater.

8. A grinding machine including one or more grinding wheels, comprising:

a workpiece holder that releasably holds an elongated workpiece and is configured to rotate the elongated workpiece about a longitudinal axis; and a workpiece centering gauge including:

a link having a first pivot configured to couple with the grinding machine;

a first encoder that measures an angle of the link at the first pivot;

a second pivot included with the link;

a measuring fork configured to releasably contact an outer surface of a workpiece;

a transducer included with the measuring fork that measures a workpiece diameter; and a second encoder that measures an angular position of the link relative to the measuring fork, wherein the angular position measured by the first encoder, the angular position measured by the second encoder, and workpiece diameter size are used to determine the deviation of the elongated workpiece from a center.

9. The grinding machine recited in claim 8, further comprising a link piston coupled to the grinding machine at one end and the link at another end for moving the link relative to the grinding machine.

10. The grinding machine recited in claim 8, further comprising a fork limiting rod coupled to the link at one end and the measuring fork at another end for limiting angular movement of the measuring fork.

11. The grinding machine recited in claim 8, wherein polar coordinates are calculated and then converted to cartesian coordinates.

12. The grinding machine recited in claim 8, wherein the elongated workpiece is a crankshaft.

13. The grinding machine recited in claim 8, wherein the elongated workpiece is 1.5 meters (m) or greater.

* * * * *